US007575201B2

(12) United States Patent
Bartonek

(10) Patent No.: US 7,575,201 B2
(45) Date of Patent: Aug. 18, 2009

(54) SYSTEM AND METHOD FOR DETECTING A CHANGE OR AN OBSTRUCTION TO A RAILWAY TRACK

(75) Inventor: Mark Bartonek, Blue Springs, MO (US)

(73) Assignee: General Electric Company, Schenectady, NY (US)

( * ) Notice: Subject to any disclaimer, the term of this patent is extended or adjusted under 35 U.S.C. 154(b) by 557 days.

(21) Appl. No.: 11/206,959

(22) Filed: Aug. 18, 2005

(65) Prior Publication Data

US 2007/0040068 A1 Feb. 22, 2007

(51) Int. Cl.
*B61L 1/00* (2006.01)
*G01B 7/00* (2006.01)

(52) U.S. Cl. ..... 246/121; 246/122 R; 246/249; 246/293

(58) Field of Classification Search ..... 246/202, 246/120, 121, 122 R, 125, 168 R, 249, 293, 246/551, 169 R, 169 D; 340/551, 933; 324/216, 324/217, 219; 73/636
See application file for complete search history.

(56) References Cited

U.S. PATENT DOCUMENTS 4,179,744 A * 12/1979 Lowe ..... 701/35
5,512,821 A * 4/1996 Ando et al. ..... 324/225
5,864,304 A * 1/1999 Gerszberg et al. ..... 340/903
5,890,682 A 4/1999 Welk
5,954,299 A * 9/1999 Pace ..... 246/293
6,205,946 B1 3/2001 Picton
6,594,591 B2 * 7/2003 Clark et al. ..... 702/35

FOREIGN PATENT DOCUMENTS

| | | |
|---|---|---|
| EP | 0 344 145 | 5/1989 |
| GB | 2385424 | * 8/2003 |
| GB | 2424981 | 10/2006 |
| WO | WO 95/24610 | 9/1995 |
| WO | WO 97/44654 | 11/1997 |
| WO | WO 02/30729 | 4/2002 |

* cited by examiner

*Primary Examiner*—Mark T Le
(74) *Attorney, Agent, or Firm*—Robert Wawrzyn, Esq.; Terry M. Sanks, Esq.; Beusse Wolter Sanks Mora & Maire, P.A.

(57) ABSTRACT

A system for determining the capability of a railroad track to safely carry railroad vehicles over the track by sensing changes in the environment proximate the track, the system including a sensor for detecting a magnetic field proximate the railroad track and generating data indicative of the magnetic field, a processor for processing data from the sensor to identify changes in the magnetic field proximate the track, and a communication device in communication with the processor for transmitting indicia indicative of changes in the environment proximate the track affecting the capability of the track to safely carry railroad vehicles.

14 Claims, 3 Drawing Sheets

SYSTEM AND METHOD FOR DETECTING A CHANGE OR AN OBSTRUCTION TO A RAILWAY TRACK

FIELD OF THE INVENTION

The present invention relates to rail transportation and, more particularly, to sensing railway washout, a shifted railway, pumping ties, and/or an automobile stationary on a railway crossing.

BACKGROUND OF THE INVENTION

A railway track typically has a pair of steel rails supported by a plurality of perpendicularly disposed ties that rest on a ballast material. Many railway tracks are located in remote areas where readily accessing the condition of a track may not occur if no known incident has occurred which may cause damage to the track. For example, railway tracks, or railways, may become damaged from storms or other natural occurrences, such as earthquakes, where the tracks may shift position. The shift can be caused by shifting ties and/or displacement of the ballast material. In other instances, such as where tracks are located adjacent to bodies of water, the ballast may shift or wash away resulting in the ties and hence the tracks shifting position. A track can also experience a shift due to a man-made accident, for example, a barge hitting a pillar or pillars supporting a bridge.

Similarly, with excessive pumping ties, in particular cement ties, can become damaged from beating against the ballast. Pumping ties are a condition caused by poorly maintained ballast material (rocks) under railroad ties. When a train wheel passes over the tie, the tie is driven down into the rocks. Once the wheel rolls over the tie, the tie rises out of the rock. The lowering and then rising of the tie can be many inches of travel. Wood ties allow for quite a bit of movement. However, when concrete ties are used, this pumping into the rocks causes the cement tie to chip away slowly on the bottom of the tie, which ultimately leads to early failure of the concrete tie.

Another occurrence that leads to train derailments and/or deaths is when automobiles (cars, trucks, buses, etc) stop on railroad crossings. Though locomotive engineers can visibly see when a vehicle is on a railroad track prior to reaching the vehicle, in some situations not enough time is available for the train to slow down and/or stop. When a vehicle is trapped by a crossing arm, situations result where the only way the vehicle can free itself is by running into and breaking the crossing arm. However, most drivers usually do not take such action.

If a train has a dragging car, caused by the wheels on the car malfunctioning or where the wheels have jumped the track due to a shifted rail, such incidences are not always immediately noticed. Failure to notice such an incident could result in a train derailment.

Such damage to a railway, blocking of a railway, and/or malfunction of a car on a train, can result in derailment of the train. With respect to railway damage, currently the best option to identify railway changes is by visual inspections. Even when visual inspections are performed, depending on the damage already occurred and/or frequency of the inspections, it is possible that existing or pending railway shifting may be missed or not identified timely enough.

BRIEF DESCRIPTION OF THE INVENTION

The present invention is directed to a system and method for sensing railway washout, a shifted railway, pumping ties, and/or an automobile stationary on a railway crossing. When such occurrences happen, information regarding these occurrences are reported to a location so as to prevent a train from encountering the railroad track at these locations.

Towards this end a system for determining the capability of a railroad track to safely carry railroad vehicles over the track by sensing changes in the environment proximate the track is disclosed. The system comprises a sensor for detecting a magnetic field proximate the railroad track and generating data indicative of the magnetic field. A processor for processing data from the sensor to identify changes in the magnetic field proximate the track is also part of the system. Another part of the system is a communication device in communication with the processor for transmitting indicia indicative of changes in the environment proximate the track affecting the capability of the track to safely carry railroad vehicles.

A method of determining the capability of a railroad track to safely carry railroad vehicles over the track by sensing changes in the environment proximate the track is also disclosed. The method comprises a step of detecting a magnetic field proximate the railroad track. Generating data indicative of the magnetic field, and identifying changes in the magnetic field proximate the track are also steps in the method. The method also comprises transmitting indicia indicative of changes in the environment proximate the track affecting the capability of the track to safely carry railroad vehicles.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
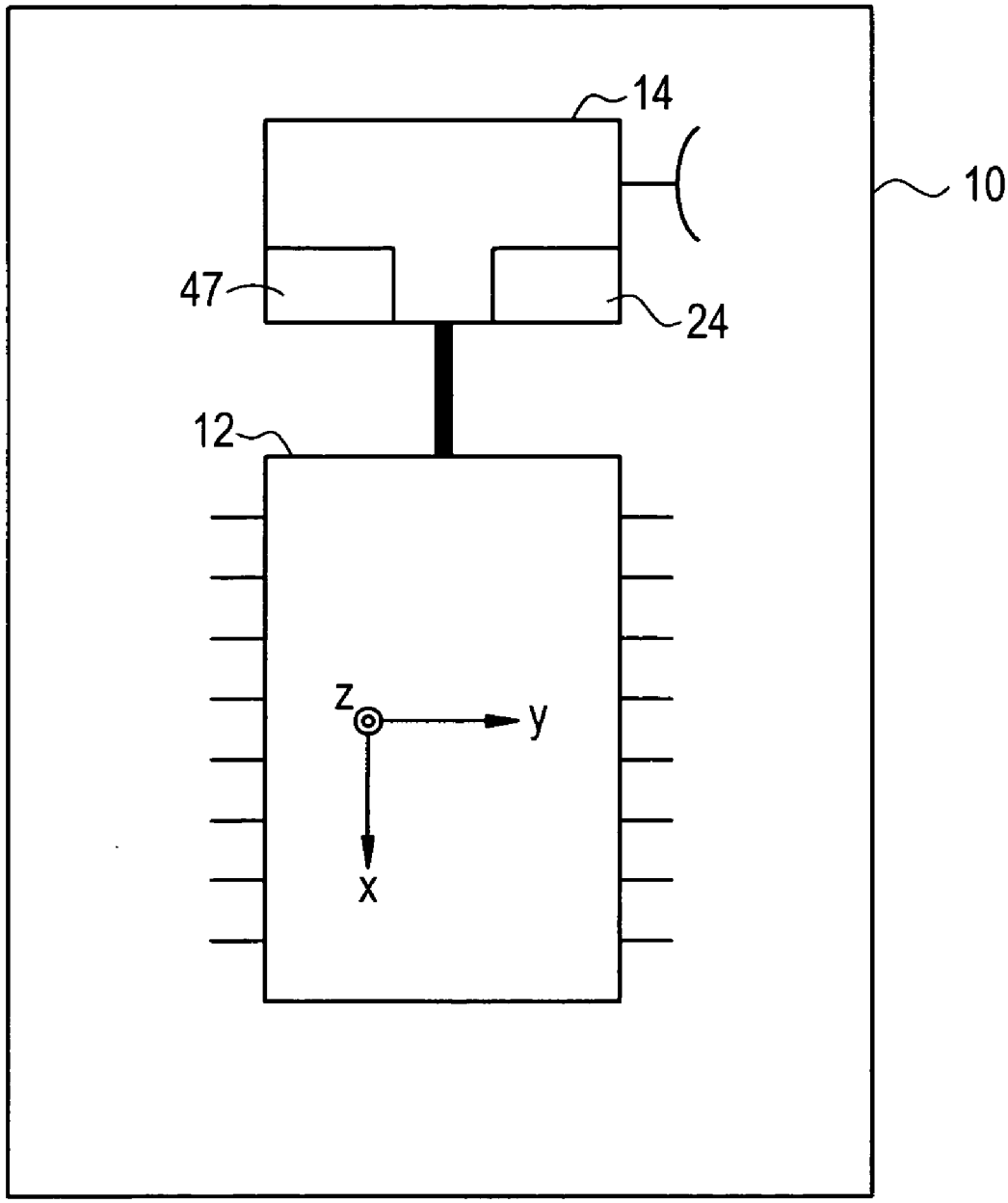
FIG. 1 is an illustration of an exemplary embodiment of the present invention.

FIG. 1 is an illustration of an exemplary embodiment of the present invention. As illustrated, a sensor package 10 has a sensor 12 with an embedded processor 14. The sensor 12 is a three-axis magnetic sensor 12, such as a Honeywell HMC2003 three-axis magnetometer. The sensor 12 measures low magnetic field strengths along an X-axis, a Y-axis, and a Z-axis wherein changes outside of a given range in the magnetic field around the sensor can be detected. In a preferred embodiment, the sensor provides an analog signal and the ground, or earth, is used as the magnetic field reference.

Figure 2:
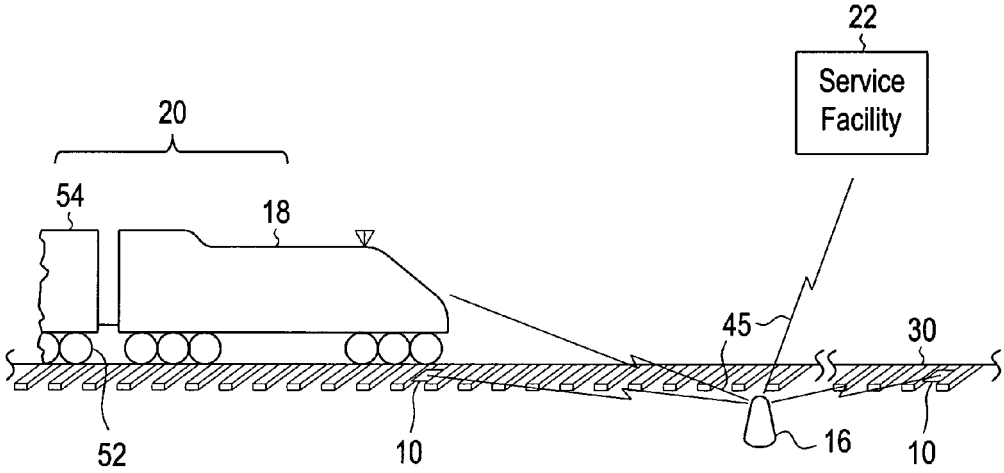
FIG. 2 is an illustration of exemplary embodiments of the present invention in communication with a service facility and a train.

The processor 14 is provided to allow for communication of magnetic field readings between a sensor 12 connected to the processor, a plurality of sensors 12 and a wayside unit, or communication device, 16 and/or a locomotive 18. Communication can occur over industry standard networks such as, but not limited to, a Controller Area Network ("CAN"). CAN is an electronics industry standard vital protocol used for communication between embedded processors. Communication also can occur between the wayside unit 16, a train 20, and a service facility, or depot, 22, as illustrated in FIG. 2. Though not illustrated, communication can also occur between the wayside unit 16 and railway equipment operable to prevent train movement towards the railway where the change in magnetic field has been detected.

With respect to each sensor/processor combination 10, or package, the processor 14 will also digitize the analog signal provided from the sensor 12. Depending on the type of application the sensor/processor package 10 is being used for, as will be discussed below in more detail, the processor 14 will apply a specific software filter algorithm 24 to the signal to further reduce noise. Furthermore, based on commands received from the wayside unit 16, the processor 14 will also function to measure the outputs from the sensor 12 and save the measurements as a zero reference value to be used as a reference for any magnetic field changes detected.

Figure 3:
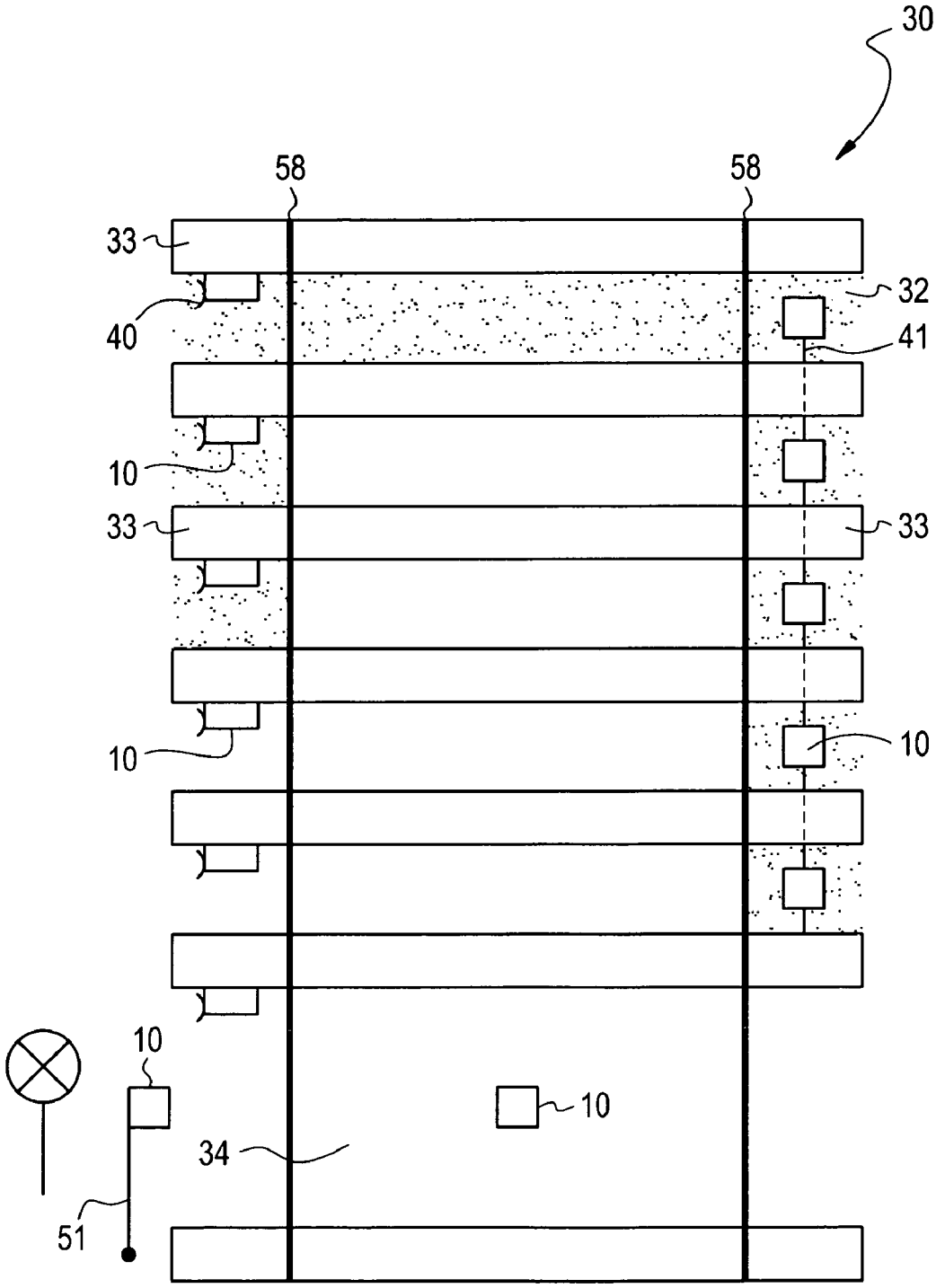
FIG. 3 is an illustration of exemplary embodiments of the present invention being used for a plurality of purposes at different locations along a railway.

FIG. 3 is an illustration of exemplary embodiments of how the sensor/processor packages 10 are used with a railway 30. Depending on the intended purpose, the sensor/processor package 10 is placed either within the ballast material 32, attached to railway ties 33, and/or placed within a railroad crossing area 34. In a preferred embodiment with any application, the packages 10 are placed at fixed intervals which determine an amount of coverage desired.

As illustrated, the wayside unit 16 interfaces with the sensors 12, via each respective sensor's processor 14 via the communication network 40, 41. Communication between the sensor/processor packages 10 and the wayside unit 16 can occur through a wireless network 40, a wired network 41, and/or a combination of both. The wayside unit 16 is operable to command the sensors 12 to zero reference output as well as to communicate 45 with a train 20 and/or depot 22 via radio and/or other communication protocols. The type of detection resolution would be determined by how many sensor/processor packages are installed.

Though the uses of the present invention are numerous, several uses are readily identifiable. By placing a network of the present invention in an automobile crossing area of a railroad track 34, or railroad crossing, it is possible to detect automobiles present in the crossing area 34 as a train 20 is approaching the crossing area 34. This is possible due to the sensor(s) 12 detecting a change in the magnetic field over the crossing area 34. In this application, with respect to an individual sensor/processor combination 10, the processor 14 applies a low pass filter 47 to the sensor output to eliminate any noise interference. The low pass filter cutoff frequency is high enough to allow detection of objects passing through the crossing area 34, especially if any objects remain over the crossing area 34.

In this application, the wayside unit 16 receives a signal from the crossing sensor (not illustrated) to indicate that the train 20 is approaching and that the crossing guard is activating. The wayside unit 16 communicates to the crossing system if the crossing is clear of automobiles, using the sensor/processing package 10, and also relays this information to the locomotive 20. In another preferred embodiment, the wayside unit 16 is configured to constantly supply crossing status to the crossing detector. If an automobile were upon the tracks 30, a warning is sent, via the wayside unit 16, to the approaching train 20. In another preferred embodiment, the sensor/processing package 10 is attached to the crossing guard arm. When the arm 51 lowers into place when a train 20 is approaching, if the magnetic field around it is different, or in other words if a vehicle is detected as being on the tracks, the arm will automatically lift allowing the vehicle to leave the crossing area without having to break the crossing arm 51.

Another application for the present invention is for detecting shifted rail and another is for pumping ties. Tie 33 movement in three directions is detectable using the present invention and the earth's magnetic field for reference. Likewise, a shifted rail is also detectable prior to a train approaching that part of the track. In this application, the wayside unit 16 applies a low pass filter 47 to the sensors at a high enough cutoff frequency to detect tie movement for all train speeds. The wayside unit 16 reports track status to the depot 22. If a change in track conditions is detected, specifically a change in tie 33 location is detected, in addition to reporting the change to the depot 22, a warning signal is sent to any locomotives 18 that are approaching that part of the track 30. The signal 45 reported to any approaching trains 20 can be, but is not limited to, an alarm, voice message, etc. The signal 45 may also be sent to other railway equipment, such as an interlocking (not illustrated) to block train movement towards the detected shifted track.

In another application, if wheels 52 on one of the cars 54 being pulled by the locomotive 18 consist are malfunctioning, such as if the wheels 52 have jumped the track, the present invention is used to detect this problem. Since the metal of the wheels 52 of the car 54 are likely to contact the ties 33 or drag against the side of the rails 57, a change in the magnetic field would be realized since the magnetic field around the dragging wheels 52 would change when compared to the other cars 54 that make up the train 20. Towards this end, the present invention would detect the change in magnetic field caused by the dragging wheels 52.

In another application, the present invention is used to detect ballast 32 washout. By using a network of sensor/processor packages 10 buried in the ballast 32 at fixed intervals, it is possible to determine the movement of the railroad ballast 32 based on a change in the magnetic field due to ballast 32 movement. The processor 14 applies a very low frequency low pass filter algorithm 47 to the sensor 12 output to eliminate false signals. The sensor/processor package 10 outputs are monitored by the wayside unit 16 that will command the processors 14. The processors 14 communicate any changes detected in the magnetic field to the wayside unit 16. The wayside unit 16 sends a signal warning and/or status report 45 to, via voice message, alarm, etc., approaching trains 20, a communication to a railroad service facility 22, or a communication to signal controlling equipment such as an interlocking to block train movement over that stretch of rail.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A system for determining the capability of a railroad track to safely carry railroad vehicles over the track by sensing changes in an environment proximate the track, the system comprising:

a) a sensor for detecting a magnetic field proximate the railroad track and generating data indicative of the magnetic field, wherein the sensor is fixed within the railway ballast material to determine whether the magnetic field around the ballast material changes, said railway ballast material being within the environment proximate the railroad track;

b) a processor for processing data from the sensor to identify changes in the magnetic field proximate the track that affect the capability of the railroad track to safely carry railroad vehicles, said change in the magnetic field resulting from a movement of the railway ballast material; and c) a communication device in communication with the processor for transmitting indicia indicative of changes in the environment proximate the track affecting the capability of the track to safely carry railroad vehicles.

2. The system of claim 1 wherein changes in the environment proximate the track that affect the capability of the track to safely carry railroad vehicles includes changes in support for the railroad track.

3. The system of claim 1 wherein changes in the environment proximate the track that affect the capability of the track to safely carry railroad vehicles includes objects that have been positioned adjacent the track and that may interfere with the travel of the railroad vehicles along the track.

4. The system of claim 1 wherein changes in the environment proximate the track that affect the capability of the track to safely carry railroad vehicles includes objects that have been positioned across the track and that may interfere with the travel of the railroad vehicles along the track.

5. The system of claim 1 wherein the communication device gives notice of the loss of support for the track to at least one of a train, a service facility, and railway equipment operable to prevent train movement towards the monitored track.

6. The system of claim 1 wherein each sensor is capable of determining a change in the magnetic field in multi-directions.

7. The system of claim 1 wherein the processor further comprises a filter to reduce a noise signal detected by the sensor.

8. The system of claim 7 wherein said filter comprises at least one of a high pass filter and a low pass filter.

9. A method of determining the capability of a railroad track to safely carry railroad vehicles over the track by sensing changes in the environment proximate the track, wherein said change results from a movement of a railway ballast material, the method comprising:

a) positioning sensors within the railway ballast material in the environment proximate the track;

b) detecting a magnetic field proximate the railroad ballast material;

c) generating data indicative of the magnetic field;

d) identifying changes in the magnetic field proximate the track as indicative of the movement of the railway ballast material that affect the capability of the track to safely carry railroad vehicles; and e) transmitting indicia indicative of changes in the environment proximate the track affecting the capability of the track to safely carry railroad vehicles.

10. The method of claim 9 wherein the step of identifying changes in the magnetic field further comprises detecting changes in support for the railroad track so as to safely carry railroad vehicles on the track.

11. The method of claim 9 wherein the step of identifying changes in the magnetic field further comprises detecting objects that have been positioned adjacent the track and that may interfere with the travel of the railroad vehicles along the track.

12. The method of claim 9 wherein the step of identifying changes in the magnetic field further comprises detecting objects that have been positioned across the track and that may interfere with the travel of the railroad vehicles along the track.

13. The method of claim 9 wherein the step of transmitting indicia indicative of changes in the environment further comprises transmitting when loss of support for the track is detected to at least one of a train, a service facility, and railway equipment operable to prevent train movement towards the monitored track.

14. A system for determining the capability of a railroad track to safely carry railroad vehicles over the track by sensing changes in an environment proximate the track, the system comprising:

a) a sensor for detecting the earth's magnetic field proximate the railroad track and generating data indicative of the magnetic field, wherein the sensor is attached to a railway tie to determine whether the railway tie has moved beyond a predetermined threshold, said determination based on a magnetic field difference during a movement of said railway tie having exceeded the predetermined threshold, said railway tie being within the environment proximate the railroad track;

b) a processor for processing data from the sensor to identify changes in the magnetic field proximate the track that affect the capability of the railroad track to safely carry railroad vehicles, said change in the magnetic field resulting from a movement of the railway tie; and c) a communication device in communication with the processor for transmitting indicia indicative of changes in the environment proximate the track affecting the capability of the track to safely carry railroad vehicles.

* * * * *